US007607941B2

(12) United States Patent
Takahashi et al.

(10) Patent No.: US 7,607,941 B2
(45) Date of Patent: Oct. 27, 2009

(54) CONNECTOR-MOUNTING CONFIGURATION

(75) Inventors: Shinji Takahashi, Niwa-gun (JP); Yoshiaki Kato, Niwa-gun (JP); Harehide Sasaki, Niwa-gun (JP); Katsumasa Matsuoka, Niwa-gun (JP); Hiroshi Kobayashi, Okazaki (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/778,244

(22) Filed: Jul. 16, 2007

(65) Prior Publication Data

US 2008/0020608 A1 Jan. 24, 2008

(30) Foreign Application Priority Data

Jul. 18, 2006 (JP) ..... 2006-195632

(51) Int. Cl.
*H01R 13/73* (2006.01)

(52) U.S. Cl. ..... 439/567; 439/573

(58) Field of Classification Search ..... 439/567, 439/571, 572, 573, 570
See application file for complete search history.

(56) References Cited

U.S. PATENT DOCUMENTS 6,375,498 B1 * 4/2002 Yu et al. ..... 439/567
6,454,599 B1 * 9/2002 Wu ..... 439/567
6,461,175 B2 * 10/2002 Okamoto ..... 439/92
6,471,544 B1 * 10/2002 Huang ..... 439/567
6,482,031 B1 * 11/2002 Chen et al. ..... 439/567
6,638,106 B1 * 10/2003 Wu ..... 439/567
6,699,068 B2 * 3/2004 Wu ..... 439/541.5
6,805,582 B2 * 10/2004 Hu ..... 439/567
6,923,662 B2 * 8/2005 Sasame et al. ..... 439/79
7,052,317 B2 * 5/2006 Hara et al. ..... 439/567

FOREIGN PATENT DOCUMENTS

JP 63-117064 U 7/1988

* cited by examiner

*Primary Examiner*—Hien Vu
(74) *Attorney, Agent, or Firm*—Roberts Mlotkowski Safran & Cole, P.C.; Thomas W. Cole

(57) ABSTRACT

This connector-mounting configuration comprises: a latching claw that is provided at a connector and latches to a substrate, whereby the substrate is equipped with the connector; a protruding portion that is provided so as to protrude from the latching claw and latches to the substrate, whereby the latching claw latches to the substrate; and a flexing portion that is formed from a first plate member that is a plate-like component and that is disposed at a position closer to the base end side of the latching claw than the protruding portion thereof. The flexing portion is disposed so that the plate thickness direction of the first plate member coincides with the protruding direction of the protruding portion.

2 Claims, 4 Drawing Sheets

RH
FR
UP
10
12
14
16
18
20
22
24
26
28
30
32
34
36
38
40
42
44
46
48
50
52
52A
52B
56
58
60
62
64
66
68
70
72
C
40(12)

CONNECTOR-MOUNTING CONFIGURATION

CROSS-REFERENCE TO RELATED APPLICATION

This application claims priority under 35 USC 119 from Japanese Patent Application No. 2006-195632, the disclosure of which is incorporated by reference herein.

BACKGROUND OF THE INVENTION

1. Field of the Invention

The present invention relates to a connector-mounting configuration where a substrate is equipped with a connector.

2. Description of the Related Art

For connector-mounting configurations, there are devices where a latching claw unit of a connection terminal main body is latched to a print circuit substrate, whereby the print circuit substrate is equipped with the connection terminal main body. (For example, see the Official Gazette of Japanese Utility No. 63-117064.)

In the above connector-mounting configuration, a protrusion is provided at the tip of a latching claw unit, and a flexing unit is provided closer to the base end side than the protrusion of the latching claw unit. Then when the latching claw unit is inserted into an insertion hole of a print substrate, the protrusion provided at the latching claw unit is pressed against the peripheral edge of the insertion hole, the flexing unit flexes temporarily, and the latching claw unit is inserted through the insertion hole. Then the protrusion is latched to the print circuit substrate and the latching claw unit latches to the print circuit substrate.

Accordingly, if the width in the direction in which the protrusion of the flexing unit protrudes is decreased, it becomes easier for the latching claw unit to flex in the direction in which the protrusion protrudes. Accordingly, it becomes easier to insert the latching claw unit through the insertion hole of the print circuit substrate so it is easier to latch the latching claw unit to the print circuit substrate. Hence, the print circuit substrate can be easily equipped with the connection terminal main body.

SUMMARY OF THE INVENTION

The object of the present invention is to solve the above-described problems. A first aspect for achieving this object is a connector-mounting configuration comprising: a latching claw that is provided at a connector and latches to a substrate, whereby the connector is mounted onto the substrate; a protruding portion that is provided so as to protrude from the latching claw and latches to the substrate, whereby the latching claw latches to the substrate; and a flexing portion that is formed from a first plate member that is a plate-like member and disposed at a position of the latching claw closer to a base end side of the latching claw than the protruding portion thereof, the flexing portion being disposed so that the plate thickness direction of the first plate member coincides with the protruding direction of the protruding portion.

A second aspect for achieving the above object relates to the connector-mounting configuration of the first aspect, wherein the protruding portion is formed of a second plate member that is a plate-like member and protrudes in the surface direction of the second plate member.

A third aspect for achieving the above object relates to the connector-mounting configuration of the second aspect, wherein the first and the second plate members are formed integrally of a plate, and the protruding portion and the flexing portion are formed at the latching claw by bending the plate of which the first and the second plate members are formed.

A fourth aspect for achieving the above object relates to the connector-mounting configuration of one of the first to the third aspects, comprising a housing portion that is formed at a portion of the latching claw between the protruding portion and the flexing portion and is housed in a housing hole provided in the substrate, wherein the width of the housing portion along the surface direction thereof is larger than the plate thickness of the first plate member.

The connector-mounting configuration according to the first aspect has a latching claw provided at the substrate and a protruding portion provided so as to protrude from the latching claw and latched with the substrate, whereby the latching claw is latched to the substrate. Due to this, the connector is fixed onto the substrate. Further, the flexing portion is provided at a position of the latching claw closer to the base end side than the protruding portion.

The first plate member, which is a plate-like component consisting the flexing portion, is disposed so that the plate thickness direction thereof coincident with the direction of protrusion of the protruding portion. Therefore, the width along the direction of protrusion of the protruding portion at the flexing portion can be decreased so that the flexing portion can be made to easily flex in protrusion direction of the protruding portion. Due to this, the latching claw can be made to easily latch to the substrate and fixation of the connector onto the substrate can be performed with ease.

In the connector-mounting configuration of the second aspect, the protruding portion is formed at the second plate member and it protrudes in the direction facing the second plate member. Accordingly, the protruding portion can be easily formed at the second plate member by cutting out the protruding portion from the second plate member.

In the connector-mounting configuration of the third aspect, the first plate member and the second plate member are formed as an identical plate member, and the plate member is bent so that the protruding portion and the flexing portion are provided at the latching claw. Therefore, the first plate member forming the flexing portion can be easily formed so that the thickness direction coincident with the protruding direction of the protruding portion, and accordingly, the protruding portion and flexing portion can be provided easily at the latching claw.

In the connector-mounting configuration of the fourth aspect, the housing portion is formed at a portion between the protruding portion and the flexing portion of the latching claw, and is housed in a housing hole provided in the substrate.

The housing portion is formed so that width along the surface thereof is larger than the plate thickness of the first plate member. Consequently, by fixing the housing portion onto the substrate by solder in the housing hole, the housing portion can be solidly fixed to the substrate, and thus, the connector can be solidly fixed to the substrate.

DESCRIPTION OF THE PREFERRED EMBODIMENTS

1. First Exemplary Embodiment

Figures 1A, 1B, 1C:
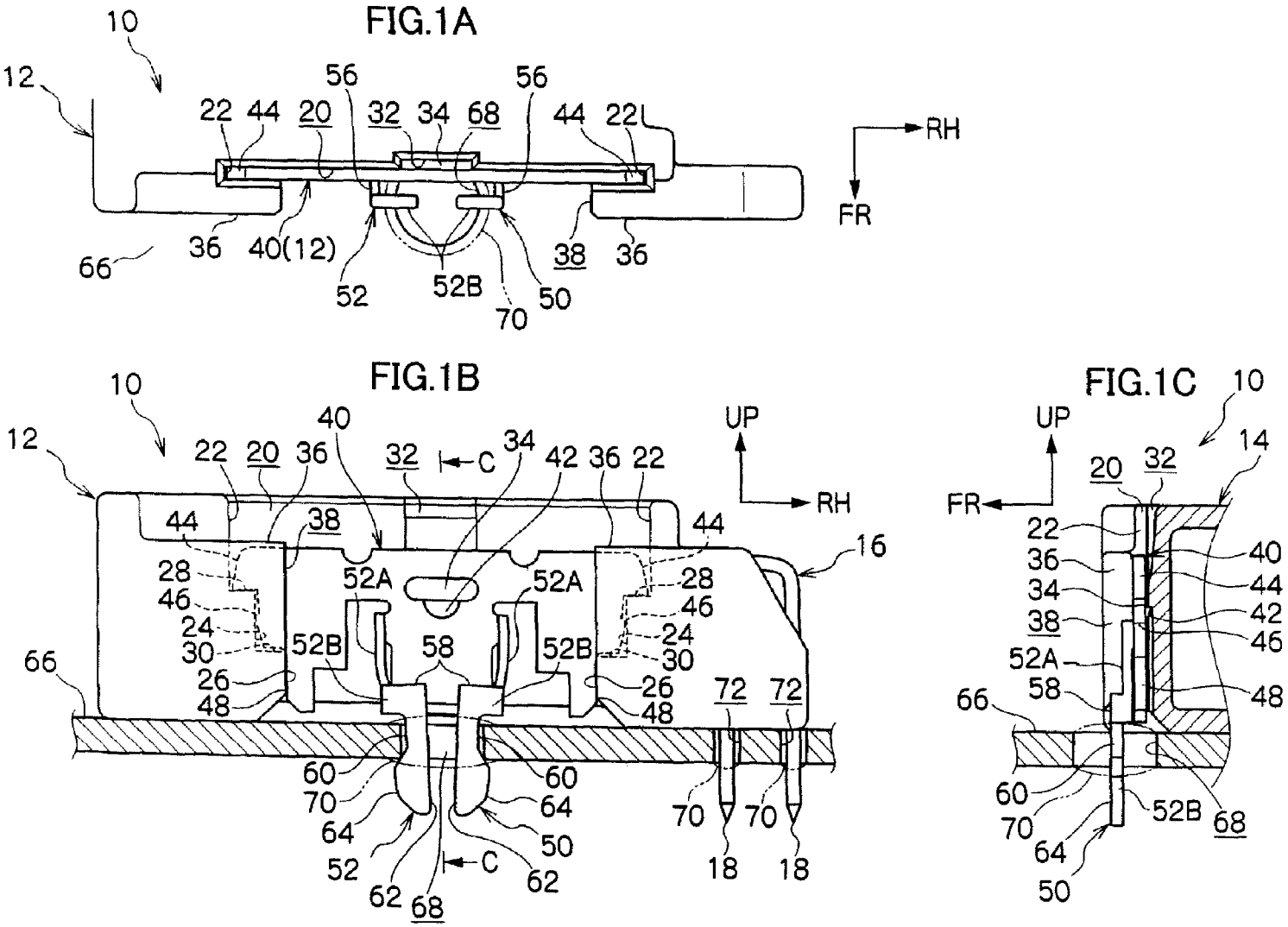
FIGS. 1A, 1B, and 1C are, respectively, a plan view of a connector-mounting configuration according to a first exemplary embodiment as seen from above, a frontal view of the connector-mounting configuration as viewed from the front, and a cross-sectional view of the connector-mounting configuration as viewed from the right.

As shown in FIGS. 1A-1C, a connector-mounting configuration 10 according to the first exemplary embodiment is provided with a connector 12. In the drawings of FIG. 1A and the followings, the arrow FR indicates a forward direction with respect to the connector-mounting configuration 10 (i.e., a longitudinal direction of the connector-mounting configuration 10), the arrow RH indicates a rightward direction with respect to the connector-mounting configuration 10, and the arrow UP indicates an upward direction with respect to the connector-mounting configuration 10.

The connector 12 has a substantially rectangular container-shaped case 14 formed of resin. The case 14 is equipped with an electrical part 16. A predetermined number of terminals 18 are provided at the electrical part 16, and the terminals 18 protrude downward from the bottom surface of the case 14.

A substantially rectangular installation groove 20 (i.e., an installation hole) is formed at the front portion of the case 14, and the upper and bottom surfaces of the installation groove 20 are open. Insertion surfaces 22, pressing surfaces 24, and fitting surfaces 26 are formed from the top to the bottom of each lateral side surface of the installation groove 20. The distance between each side located in a lateral in the lateral direction of the pair of insertion surfaces 22 is greater than the distance in the lateral direction of the pair of pressing surfaces 24, and the distance in the lateral direction of the pair of pressing surfaces 24 is greater than the distance in the lateral direction of the pair of fitting surfaces 26. Further, horizontal upper level surfaces 28 are formed between the insertion surfaces 22 and the pressing surfaces 24, and horizontal lower level surfaces 30 are formed between the pressing surfaces 24 and fitting surfaces 26.

An insert depression 32 whose cross-section is rectangular is formed in the center of the rear surface of the installation groove 20. The insert depression 32 is formed along the vertical direction and the top and bottom portions thereof are open. A latching protrusion 34 whose cross-section is triangularly shaped is formed inside the insert depression 32. The front surface of the latching protrusion 34 is slanted so as to protrude forwardly as descending toward the bottom, and the bottom surface of the latching protrusion 34 is arranged horizontal (i.e., perpendicular to the vertical direction).

Flat plate-like front walls 36 are provided on the case 14 at the front end (i.e., at the front side of the installation groove 20). The front walls 36 are arranged so as to face the middle or lower portion a portion of the installation groove 20 of the insertion surfaces 22 along the vertical direction.

An open groove 38 (i.e., open hole), which has a rectangular shape when viewed from the forward thereof, is formed to pass through the front walls 36 at the central portion in the lateral direction. The open groove 38 is communicated with the installation groove 20 and the top and bottom portions thereof are open. The right and left side surfaces of the open groove 38 are arranged to be perpendicular to the lateral direction (i.e., arranged along the vertical direction), and made to be the same surfaces as the fitting surfaces 26.

The connector 12 has a substantially rectangular metal peg 40 that acts as an mounting component. The peg 40 is inserted into the installation groove 20 of the case 14 from the above and thus mounted to the case 14.

A latching unit 42 having an elasticity is formed in the center portion in the lateral direction at the upper portion of the peg 40 as shown in FIGS. 1A-1C and 2A-2C. the latching unit 42 is formed so as to be semicircular when seen from the front and to be reversed triangular when seen from the side. The latching unit 42 protrudes toward the rear side from the peg 40. The top surface of the latching unit 42 is formed to be horizontal. The top surface of the latching unit 42 is latched to the bottom surface of the latching protrusion 34 on the insert depression 32, whereby the peg 40 is latched so as not to move upward relative to the case 14.

Substantially rectangular plate like insertion units 44 that protrude towards the outer sides in the lateral direction are formed at both side portions in the lateral direction at the upper portion of the peg 40. The insertion units 44 are arranged between the pair of insertion surfaces 22 in the installation groove 20, as shown in FIGS. 1A-1C. The bottom edges of the insertion units 44 are latched to the upper level surfaces 28 of the installation groove 20, whereby the peg 40 is latched so as to not move downward relative to the case 14.

Figure 2A:
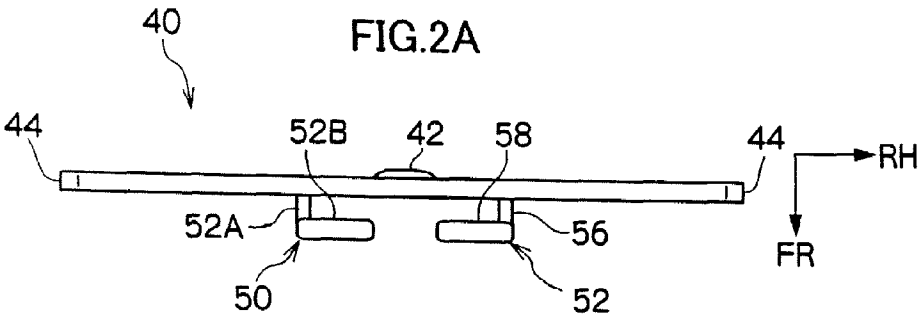
FIGS. 2A, 2B, and 2C are, respectively, a plan view of a peg of the connector-mounting configuration according to the first exemplary embodiment as seen from above, a frontal view of the peg as viewed from the front, and a cross-sectional view of the peg as viewed from the right.
Figure 2B:
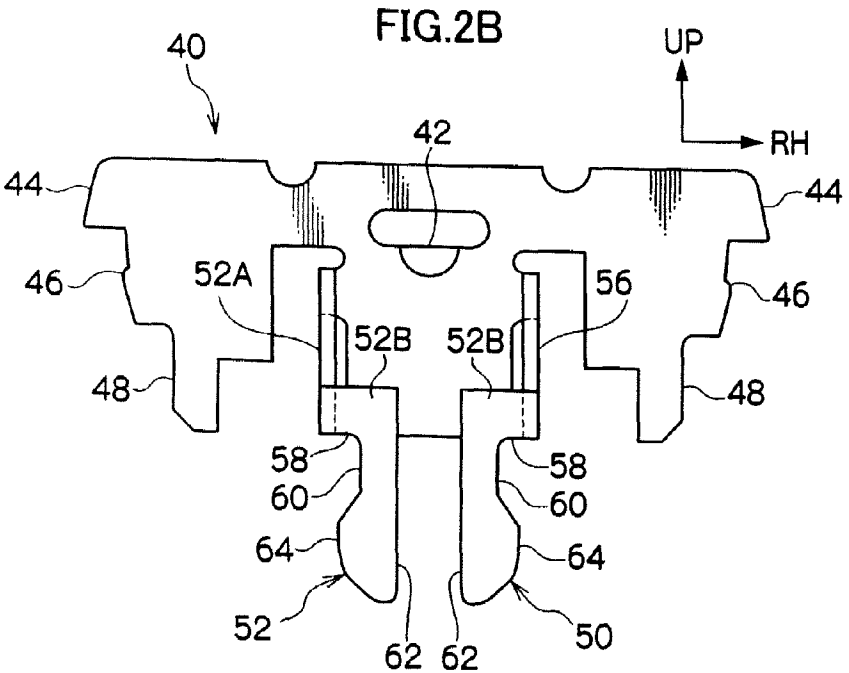
Figure 2C:
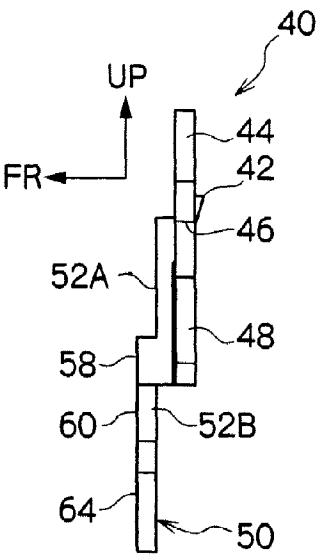

As shown in FIGS. 2A-2C, substantially triangular plate-like pressing portions 46 are formed at portions at both sides in the lateral direction in the middle portion of the vertical direction of the peg 40. The pressing portions 46 are formed so as to protrude toward the outer sides in the lateral direction of the peg 40. The pressing portions 46 of the peg 40 are arranged between the pair of pressing surfaces 24 of the installation groove 20, as shown in FIGS. 1A-1C. The pressing portions 46 are pressed to the pressing surfaces 24, whereby movement upward relative to the case 14 of the peg 40 is restricted.

As shown in FIGS. 2A-2C, substantially rectangular plate-like fitting portions 48 extend towards the bottom from both the end portions at the left and right in the bottom part of the peg 40. The fitting portions 48 are arranged at the inner side of the pressing portions 46 in the lateral direction of the peg 40 and fit between the pair of fitting surfaces 26 of the installation groove 20.

Figure 3:
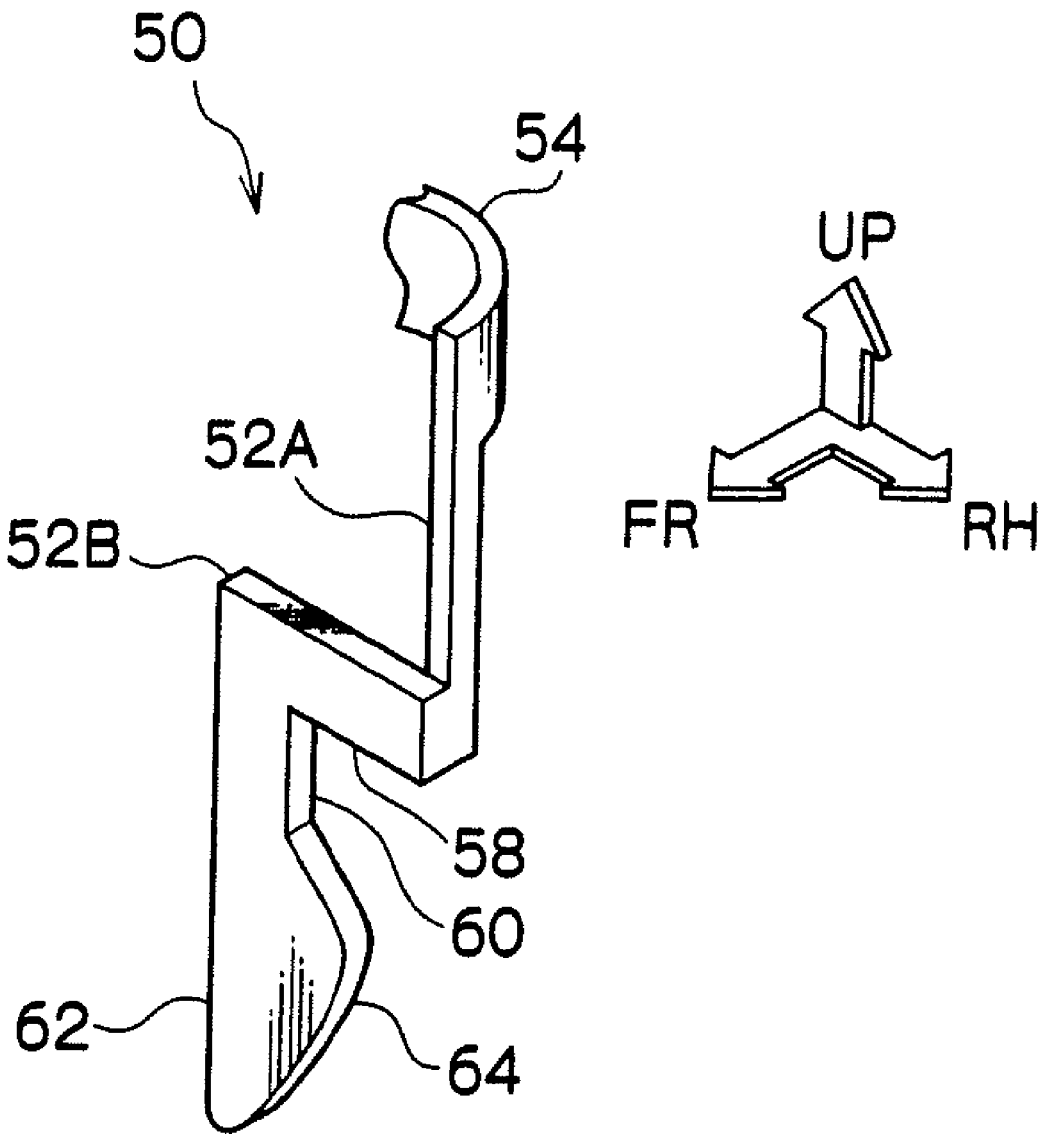
FIG. 3 is a perspective view of the right side of a latching claw of the connector-mounting configuration according to the first exemplary embodiment as seen from the right at an angle.

Latching claws 50 are formed by being cutout from the peg 40, as shown in FIGS. 1A-1C and 2A-2C. As shown in FIG. 3, the latching claws 50 protrude downward with respect to the bottom surface of the case 14. The latching claws 50 are configured integrally with the peg 40 and plate members 52, as shown in FIG. 3, and the plate members 52 are configured to be integral with a first plate member 52A, a second plate member 52B, and a third plate member 52C.

The rear side portion of the upper end of the latching claw 50 is formed by third plate member 52C, which is a curved plate-like member. A bent portion 54 is provided at the latching claw 50 at the third plate member 52C portion. The rear end of the third plate member 52C (i.e., bent portion 54) is integral with the peg 40 and the third plate member 52C (i.e., bent portion 54) is bent or curved in an angle of 90 degree with respect to the front side of the peg 40.

The upper and front side portions of the latching claw 50 are formed of the long plate-like plate member 52. A flexing unit 56 is provided at the latching claw 50 in the first plate member 52A. The upper end of the first plate member 52A (flexing unit 56) is integral with the front end of the third plate member 52C (bent portion 54). The first plate member 52A (flexing unit 56) extends along the vertical direction. The surface directions (i.e., surface directions of the surface and back surface) of the first plate member 52A (flexing unit 56) are made perpendicular to the lateral direction and the thickness direction thereof is arranges in the lateral direction. The first plate member 52A (flexing unit 56) is disposed so that the dimension along the front-to-rear direction thereof is smaller than the dimension thereof along the lateral direction.

The bottom side portion of the latching claw 50 is formed from the substantially reverse L-shaped flat plate second plate member 52B. The outer side ends in the lateral direction of the peg 40 of the upper side portion of the second plate member 52B are integral with the bottom end of the first plate member 52A (flexing unit 56). The second plate member 52B is curved (i.e., bent) inwardly in an angle of 90 degree with respect to the first plate member 52A (flexing unit 56) toward the peg 40 so that the surface direction (i.e., direction along the front and back surfaces) of the first plate member 52A is perpendicular to the longitudinal direction thereof and the thickness direction thereof is along the longitudinal direction thereof.

A configuring portion 58 having a rectangular plate-like configuration is provided at the latching claw 50 at the upper side portion of the second plate member 52B. The configuring portion 58 extends in the lateral direction from the bottom end of the flexing unit 56 (first plate member 52A) toward the inner side of the peg 40.

A housing portion 60 having a rectangular plate-like configuration is also provided at the second plate member 52B in the latching claw 50. The housing portion 60 extends downward from the end portion at the inner side of the configuring portion 58 and is configured so that the width thereof along the lateral direction (i.e., surface direction) is larger than the plate thickness of the first plate member 52A (flexing unit 56).

An extension 62 is provided at the bottom side portion of the second plate member 52B and this extends downward from the bottom end of the housing portion 60. A protrusion 64 having a substantially trapezoidal plate configuration (or optionally a triangular plate configuration) is provided at the bottom side portion of the second plate member 52B so as to protrude from the extension 62 in the lateral direction toward the outside the peg 40.

The connector 12A is fixed onto a flat plate-like print circuit board 66 corresponding to the substrate in the present invention.

A circular housing hole 68 is formed so as to pass through the print circuit board 66. The latching claws 50 of the peg 40 are inserted through the housing hole 68 and the housing portions 60 of the latching claws 50 are thus housed. The flexing units 56 are elastically deformed toward inside the peg 40 along the lateral direction, and the latching claws 50 come into contact at the protrusions 64 with the peripheral edge of the housing hole 68 on the lower surface of the print circuit board 66. In other words, by being thus linked, the latching claws 50 are latched to the print circuit board 66. The latching claws 50 are fixed to the print circuit board 66 by solder 70 provided inside the housing hole 68. Due to this, the connector 12 is fixed to the print circuit board 66.

Connection holes 72 are formed through the print circuit board 66 in a predetermined number, and the terminals 18 of the electrical part 16 provided on the case 14 are inserted through the connection holes 72. The terminals 18 are fixed to the print circuit board 66 by the solder 70 provided inside the connection holes 72. Due to this, the electrical part 16 is electrically connected to the print circuit board 66.

Then, the function of the present exemplary embodiment is described.

In the connector-mounting configuration 10 of the above configuration, when the connector 12 is mounted on the print circuit board 66, the pair of latching claws 50 of the peg 40 are pressed against the peripheral edge of the housing hole 68 of the print circuit board 66 at the protrusions 64, and they flex towards inside the peg 40 in the lateral direction at the flexing units 56, whereby they are inserted through the housing hole 68. Due to this, the pair of latching claws 50 are brought into contact with the peripheral edge of the housing hole 68 of the bottom surface of the print circuit board 66 at the protrusions 64 due to the restorative force (i.e., elastic force) of the flexing units 56, and thus latched to the print circuit board 66.

Figure 4A:
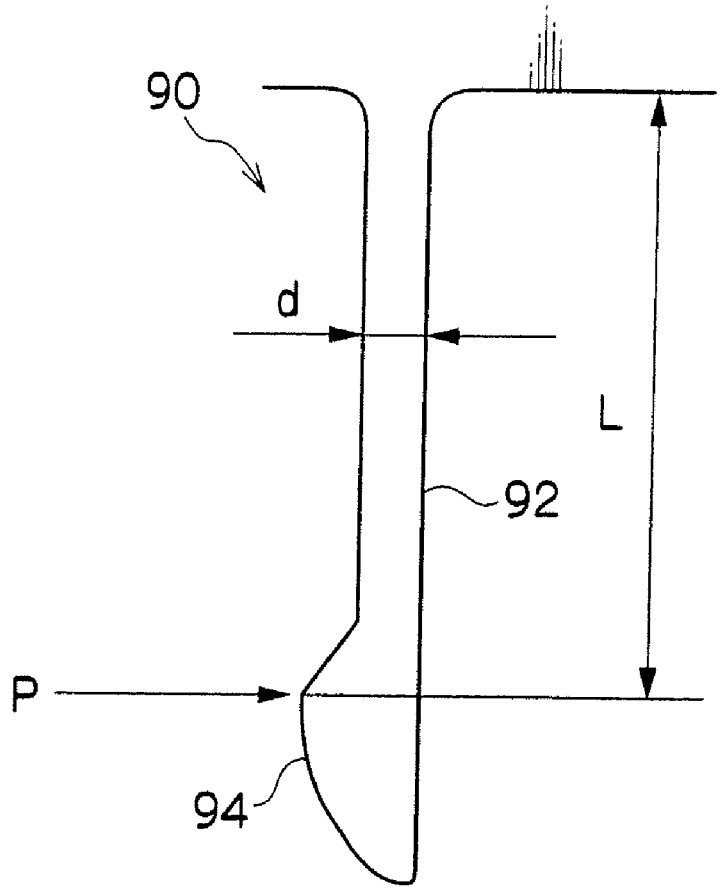
FIGS. 4A and 4B are, respectively, a frontal view a conventional flat plate-like latching claw as seen from the front, and a cross-sectional view of this latching claw as seen from above.
Figure 4B:
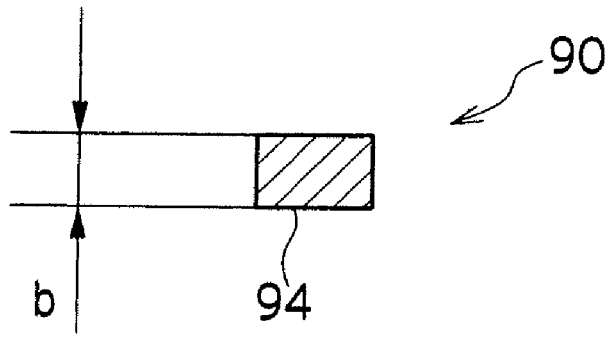

It should be noted that, as shown in FIGS. 4A and 4B, when a latching claw 90 is formed into a flat plate shape and the width of a flexing unit 92 extending in the longitudinal direction (vertical direction) of the latching claw 90 is made constant, a protrusion 94 of the tip of the latching claw 90 protrudes in the widthwise direction (lateral direction) of the flexing unit 92. Given the flex load of the latching claw 90 (i.e., the load along the lateral direction for flexing the latching claw 90) into P, given the plate thickness in the longitudinal direction of the latching claw 90 into b, given the width of the flexing unit 92 in the lateral direction into d, given the length in the vertical direction from the base end of the latching claw 90 to the working point of the flex load P into L, given the amount of displacement in the lateral direction due to the flex load P at the working point of the flex load P of the latching claw 90 into Y; and given Young's modulus of the latching claw 90 into E, the flex load P of the latching claw 90 is given by the following equation:

$$P=bd^3EY/(4L^3)$$

Accordingly, the flex load P of the latching claw 90 increases or decreases in proportion to the cube of the width d of the flexing unit 92 of the latching claw 90.

In the latching claws 50 according to the present embodiment, the plate-thickness direction of the first plate members 52A forming the flexing units 56 coincides with the directions in which the protrusions 64 protrude (i.e., in the lateral direction). For this reason, since the width in the lateral direction of the flexing units 56 can be decreased, the flexing units 56 can be formed to flex easily in the lateral direction. Due to this, the latching claws 50 can be more easily inserted through the housing hole 68 and the latching claws 50 can be more easily latched to the print circuit board 66. The force necessary for mounting the connector 12 to the print circuit board 66 can be effectively decreased so the mounting the connector 12 to the print circuit board 66 becomes easier.

Further, the protrusions 64 protrude in the surface direction of the second plate members 52B. For this reason, the protrusions 64 can be easily formed at the second plate members 52B by punching or cutting out the second plate members 52B in a configuration wherein the protrusions 64 are included.

Additionally, the plate members 52 are bent in an angle of 90 degree at the boundary portion between the first plate member 52A that comprise the flexing units 56 and the second plate members 52B that form the protrusions 64, whereby the protrusions 64 and the flexing units 56 are provided at the latching claws 50. For this reason, the thickness direction of the first plate members 52A can easily be arranged in the direction of protrusion of the protrusions 64, and the protrusions 64 and flexing units 56 can be easily provided at the latching claws 50.

In addition, since the housing portions 60 are formed at the second plate members 52B, the width of the housing portions 60 in the lateral direction (i.e., the surface directions of the second plate members 52B) can be enlarged without increasing the width of the flexing units 56 in the lateral direction (i.e., while continuing to maintain easy flexure of the flexing units 56 in the lateral direction). For this reason, the housing portions 60 can be solidly fixed to the print circuit board 66 with the solder 70 and the connector 12 can be solidly mounted to the print circuit board 66.

Although in the present exemplary embodiment, by bending the boundary portion between the flexing units 56 and the arrangements 58, the configuration was made so that the thickness directions of the first plate members 52A (i.e., flexing units 56) were faced toward the direction of protrusion of the protrusions 64, the present invention includes a configuration wherein the thickness directions of the first plate members 52A (i.e., flexing units 56) coincides with the protruding direction of the protrusions 64 by bending the boundary portion between the extensions 62 and the protrusions 64.

What is claimed is:

1. A connector-mounting configuration comprising:

a metal peg having a plate-like body including insertion units with pressing portions, each of the insertion units being on a side of the plate-like body, the insertion units terminating in fitting portions which extend downwardly and that are insertable into a substrate, the metal peg further having a pair of opposing latching claws formed at a center portion of said plate-like body and spaced from the fitting portions that latch to a substrate, whereby the metal peg is mounted onto the substrate, and wherein each of said latching claws is formed from first, second and third plate members, and includes a protruding portion that is formed from said second plate member and is provided to protrude from a side of an end of the latching claw and latches to the substrate when the latching claw is pushed through an opening in the substrate; and a flexing portion that is formed from said first plate member and being extended upwardly and that is disposed at an end of the latching claw opposite from the protruding portion thereof, wherein the third plate has a bent portion extending transversely from the flexing portion, the first, second, and third plate members being substantially orthogonally disposed with respect to each other such that the flexing portion flexes in a thickness direction of said second plate member when said protruding portion is being latched to the substrate, and wherein the first, second, and third plate members are formed integrally from a single plate, and the protruding portion and the flexing portion are formed at the latching claw by bending the plate from which the first and the second plate members are formed at a substantially right angle.

2. The connector-mounting configuration of claim 1, wherein the latching claw includes a housing portion between the protruding portion and the flexing portion that is received in a housing hole provided in the substrate when said protruding portion is latched to the substrate, wherein a width of the housing portion is larger than the thickness of the first plate member.

* * * * *